US010160198B2

(12) United States Patent
Casaldaliga Albisu et al.

(10) Patent No.: US 10,160,198 B2
(45) Date of Patent: Dec. 25, 2018

(54) PRINTER CALIBRATION

(71) Applicant: Hewlett-Packard Development Company, L.P., Houston, TX (US)

(72) Inventors: Marcos Casaldaliga Albisu, Sant Cugat del Valles (ES); Marti Rius Rossell, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/573,204

(22) PCT Filed: Jul. 15, 2015

(86) PCT No.: PCT/US2015/040569
§ 371 (c)(1),
(2) Date: Nov. 10, 2017

(87) PCT Pub. No.: WO2017/011004
PCT Pub. Date: Jan. 19, 2017

(65) Prior Publication Data

US 2018/0178507 A1 Jun. 28, 2018

(51) Int. Cl.
*B41J 2/045* (2006.01)
*B41J 2/145* (2006.01)
(Continued)

(52) U.S. Cl.
CPC ..... *B41J 2/04505* (2013.01); *B41J 2/04536* (2013.01); *B41J 2/04586* (2013.01);
(Continued)

(58) Field of Classification Search
CPC ..... B41J 2/04505; B41J 2/04536; B41J 2/04586; B41J 2/135; B41J 2/145;
(Continued)

(56) References Cited

U.S. PATENT DOCUMENTS 5,049,898 A 9/1991 Arthur et al.
6,457,800 B1 * 10/2002 Bohm ..... B41J 25/003 347/19

(Continued)

FOREIGN PATENT DOCUMENTS

EP 2826631 1/2015
WO WO-2014082671 6/2014

OTHER PUBLICATIONS

Mizes, Howard, et al. "Active Alignment of Print Heads." NIP & Digital Fabrication Conference. vol. 2009, 7 pages, No. 2. Society for Imaging Science and Technology, 2009.

*Primary Examiner* — Anh T. N. Vo
(74) *Attorney, Agent, or Firm* — Dicke Billig & Czaja PLLC

(57) ABSTRACT

A printer includes a page wide array of printing elements extending in a first orientation and co-located with a media path extending in a second orientation generally perpendicular to the first orientation. The printer is selectively operable according to a calibration involving current calibration values for a first subset of the page wide array of printing elements and a substitute calibration value for at least one non-first subset printing element of the page wide array immediately adjacent to at least one of the first subset printing elements.

15 Claims, 5 Drawing Sheets

(51) Int. Cl.

| | |
|---|---|
| ***B41J 29/393*** | (2006.01) |
| ***B41J 29/42*** | (2006.01) |
| ***B41J 2/135*** | (2006.01) |
| ***B41J 11/00*** | (2006.01) |

(52) U.S. Cl.
CPC ..... *B41J 2/135* (2013.01); *B41J 2/145* (2013.01); *B41J 11/001* (2013.01); *B41J 11/0025* (2013.01); *B41J 29/393* (2013.01); *B41J 29/42* (2013.01); *B41J 2202/19* (2013.01)

(58) Field of Classification Search
CPC ..... B41J 11/011; B41J 11/0025; B41J 29/393; B41J 29/42; B41J 2202/19
See application file for complete search history.

(56) References Cited

U.S. PATENT DOCUMENTS

| | | | | |
|---|---|---|---|---|
| 7,571,974 | B2 * | 8/2009 | Cowan | B41J 29/393 347/19 |
| 8,118,385 | B2 | 2/2012 | Van de Wynckel et al. | |
| 8,542,418 | B2 | 9/2013 | Chandu et al. | |
| 8,807,676 | B2 | 8/2014 | Yoshida | |
| 8,967,757 | B2 * | 3/2015 | Bastani | H04N 1/4015 347/19 |
| 2007/0024647 | A1 | 2/2007 | Cowan et al. | |
| 2008/0186349 | A1 | 8/2008 | Jang | |
| 2014/0198155 | A1 | 7/2014 | O'Hara et al. | |

* cited by examiner

PRINTER CALIBRATION

BACKGROUND

Achieving high image quality in printing sometimes involves periodic calibration of various components of a printer. Some aspects of such calibration may occur at a manufacturer's facility while other aspects of such calibration may occur at another site, such as an end-user's facility.

DETAILED DESCRIPTION

Figure 1:
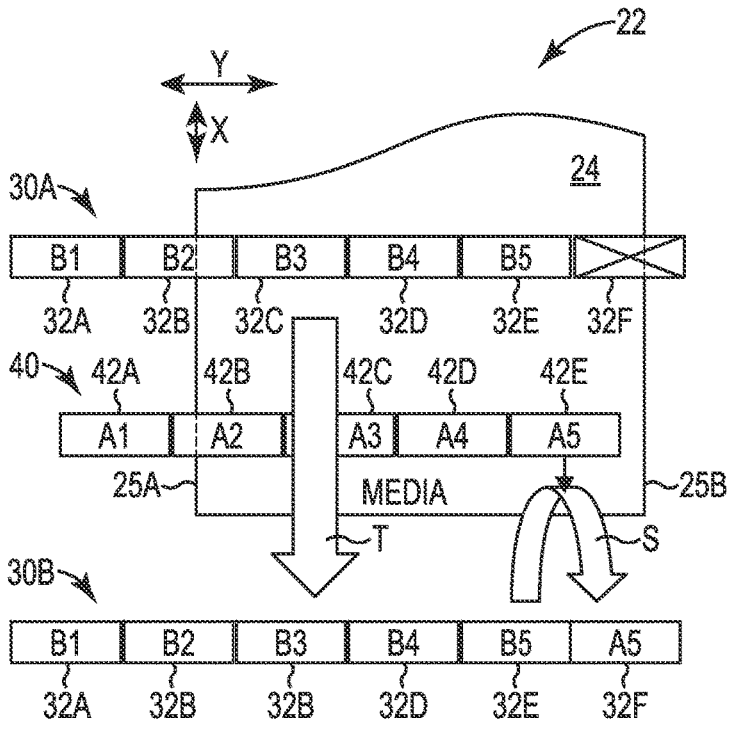
FIG. 1 is a diagram schematically representing at least some aspects of calibration of a printer, according to one example of the present disclosure.

In the following detailed description, reference is made to the accompanying drawings which form a part hereof, and in which are shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

At least some examples of the present disclosure are directed to providing a robust calibration mechanism for a page wide array (PWA) printer that is responsive to changes in a position or width of media as well as accounting for other situations. In some examples, the calibration mechanism may maintain a working calibration regarding printhead alignment, color uniformity, etc. despite some unintentional or uncontrolled changes in the printing operations.

In some examples, a printer includes a page wide array of printing elements extending in a first orientation and co-located with a media path extending in a second orientation generally perpendicular to the first orientation. The printer is selectively operable according to a calibration involving current calibration values for a first subset of the page wide array of printing elements and a substitute calibration value for at least one non-first subset printing element of the page wide array. In at least some instances, a current calibration value refers a calibration value available for use in a printing operation on a particular medium and determined in the most recently performed calibration event for that particular medium.

In some examples, the second orientation is perpendicular (e.g. at a 90 degree angle) relative to the first orientation. In some examples, the second orientation is generally perpendicular (e.g. at least a 85-89 degrees angle while not excluding a 90 degree angle) relative to the first orientation.

In some examples, a page wide array of printing elements refers to an arrangement in which the printing elements are arranged in an array (such as, but not limited to, being in series) such that the printing elements extend across the entire width of a page (e.g. medium).

In some examples, the page wide array of printing elements is considered to be co-located with a media path when the printing elements are in a position for printing onto a medium traveling in a path relative to (e.g.) the printing elements.

In some instances, the at least one non-first printing element is immediately adjacent to a respective one of the first subset printing elements through which the substitute calibration value is determined. However, in some instances, the at least one non-first subset printing element is not immediately adjacent to a respective one of the first subset printing elements through which the substitute calibration value is determined.

In some examples, the first subset printing elements are those printing elements forming a subset of a full set array of printing elements and which have current calibration values applicable to the current printing operations. Meanwhile, in some examples, the at least one non-first subset printing element is a printing element for which a current calibration value does not exist for a particular media or printing operations, and which is now under demand to participate in printing operations.

In some examples, a change in the position of a media relative to some of the printing elements may result in the involvement of an additional printing element or the cessation of a printing element in printing operations, such that the respective printing element does not have a current calibration value. In one aspect, a calibration value is pertinent in the context of a set of calibration values obtained under the same calibration process and printing conditions. Accordingly, upon a particular printing element not participating in a current calibration event, any prior calibration value for that particular printing element is no longer pertinent to current calibrations or printing operations.

However, via at least some examples of the present disclosure, providing a substitute calibration value for a particular printing element compensates for a calibration value, which may be unavailable due to the change in media position or which may be unavailable for other reasons out of the control of the operator, such as signal noise relating to a curled edge of the media or relating to misperforming nozzles of a printhead die.

In one aspect, by providing a calibration mechanism to adapt to changes in media position or width (among other changes), at least some examples of the present disclosure can, in some instances, avoid an initial calibration of a printer that involves the widest media acceptable by the printer before commencing printing with narrow media.

These examples, and additional examples, are described and illustrated in association with at least FIGS. 1-9.

FIG. 1 is a diagram 20 schematically representing at least some aspects of printing operations of printer 22, according to one example of the present disclosure. As shown in FIG. 1, printer 22 includes a page wide array 30A of printing elements 32A-32F aligned in series along a first orientation (represented by directional arrow Y). A medium 24 is aligned for travel (represented by directional arrow T) in a second orientation (represented by directional arrow X) generally perpendicular to the first orientation and therefore generally perpendicular to the printing elements 32A-32F. In some examples, the printer 22 comprises a large format printer, which may perform printing on the large format medium 24, such as a medium having a width in the range of 24 or 36 inches. In some examples, each printing element 32A-32F corresponds to a physical printhead die having at least one array of nozzles.

As represented in FIG. 1, in some examples printer 22 stores in memory a calibration value as represented by the alphanumeric references B1-B5 for each printing element 32A-32E, respectively. In some examples, printer 22 does not have a stored current calibration value for printing element 32F, and therefore no alphanumeric reference is illustrated for printing element 32F.

In one aspect, FIG. 1 illustrates a general co-location of medium 24 relative to at least printing elements 32B-32F.

FIG. 1 also represents printer 22 storing in memory an array 40 of calibration factors 42A-42E based on a prior calibration with a medium. In some examples, the media was positioned differently than medium 24 in FIG. 1 and/or had a different width than medium 24. Each calibration factor represents calibration information regarding a relationship between two neighboring printing elements. For instance, when calibrating for color uniformity, calibration factor 42A has a value (represented by alphanumeric reference A1) expressing a ratio between the color calibration value B1 (for 32A) and the color calibration value B2 (for 32B). Similarly, when calibrating for color uniformity, each calibration factor 42B-42E represents a calibration ratio between adjacent printing elements 32B:32C, 32C:32D, 32D:32E and 32E:32F, respectively, based on a prior calibration event.

Meanwhile, in some examples, when calibrating the printing elements 32A-32F relative to medium 24 for printhead alignment, each calibration factor 42A-42E has a value expressing positional information such as the difference between absolute positions of neighboring printing elements.

As shown in FIG. 1, each respective calibration factor 42A-42E has a corresponding value A1-A5 for medium 24 in its current position relative to the printing elements 32A-32F.

Accordingly, using this information, the printer 22 utilizes a prior calibration value (A5) from calibration factor 42E to replace the null value for printing element 32F, as represented by directional arrow S in FIG. 1. In some instances, a prior calibration value may sometimes be referred to as a historical calibration value.

Via updated stored array 30B, FIG. 1 also depicts a state of printing element 32F after the substitution of a calibration value A5 for printing element 32F. It will be understood that in some examples, the substituted calibration value for printing element 32F may be a calibration value directly corresponding to a printing element. However, in some examples, the substituted calibration value may be inferred from the calibration factor (e.g. 42E) involving the printing element (e.g. 32F) of interest by which the calibration information regarding printing element 32E at least partially determines a calibration value for printing element 32F. At least one example regarding a manner in which a substitute calibration value can inferred is later described in association with at least FIG. 6 regarding performing a calibration regarding color uniformity.

Figure 6:
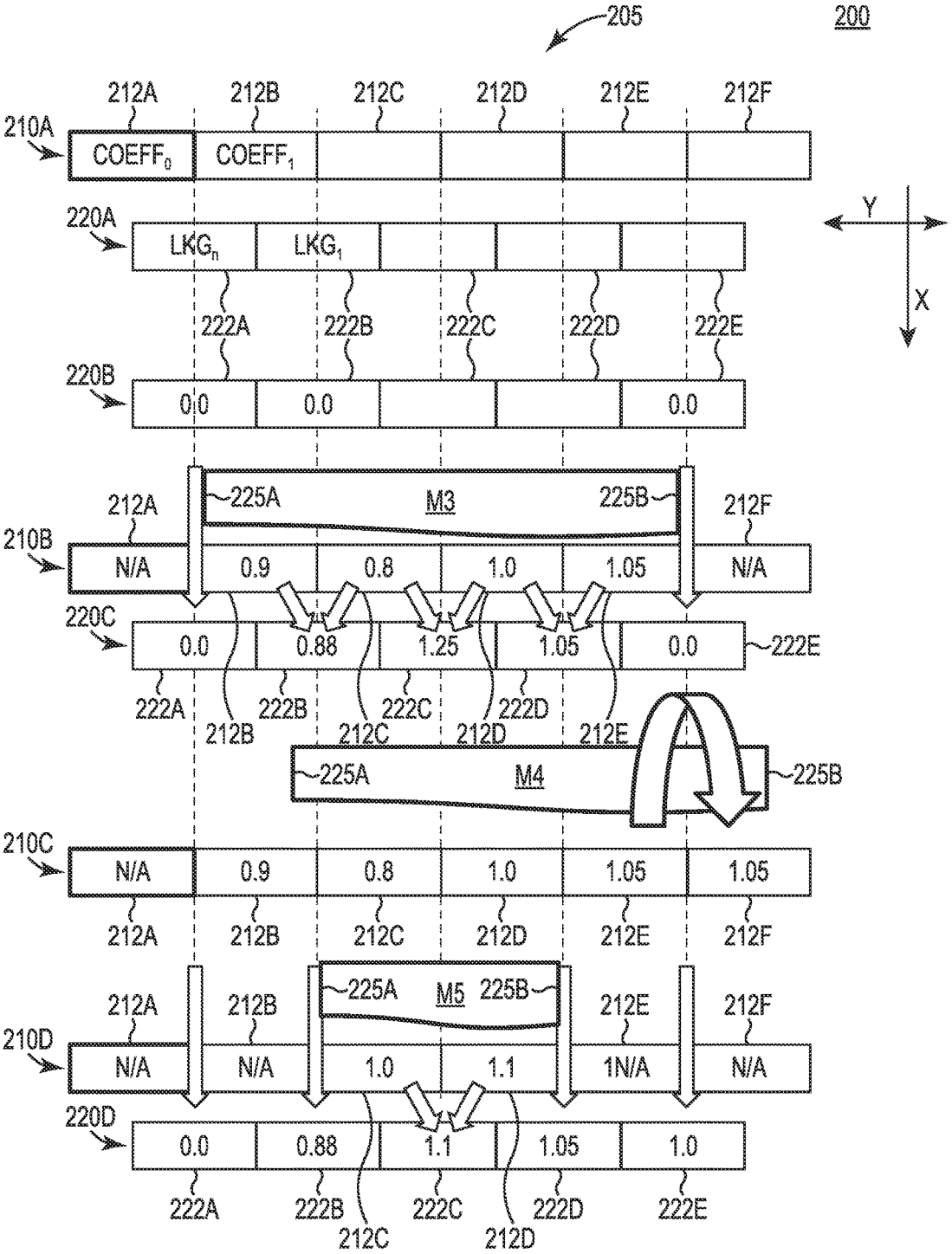
FIG. 6 is a diagram schematically representing at least some aspects of calibration of a printer, according to one example of the present disclosure.

In some examples, the calibration factors 42A-42E are referred to as last-known-good (LKG) calibration factors, which are described more fully in association with at least FIG. 6.

As will be further described throughout the present disclosure, there are many different reasons why printing element 32F may not have a calibration value. However, for illustrative simplicity, FIG. 1 depicts an example in which printing element 32F lacks a calibration value because of medium 24 having an altered position in which the medium 24 is now co-located with non-calibrated printing element 32F.

As apparent from the foregoing description, prior to commencing a printing operation (according to at least some examples of the present disclosure), the printer may update its stored calibration information to address any printing element expected to participate and which lacks a current calibration value. Further details regarding such calibration are described in association with at least FIGS. 2-9.

Figure 2:
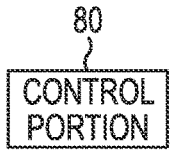
FIG. 2 is a block diagram schematically representing a control portion, according to one example of the present disclosure.

FIG. 2 is block diagram of a control portion 80, according to one example of the present disclosure. In some examples, calibration of printer 22 as described in association with FIG. 1 operates in association with a control portion 80, as shown in FIG. 2. In some examples, control portion 80 forms a portion of printer 22 or is communication with printer 22. In some examples, control portion 80 forms part of, or operates in association with, control portion 380 of FIG. 8A.

Figure 3:
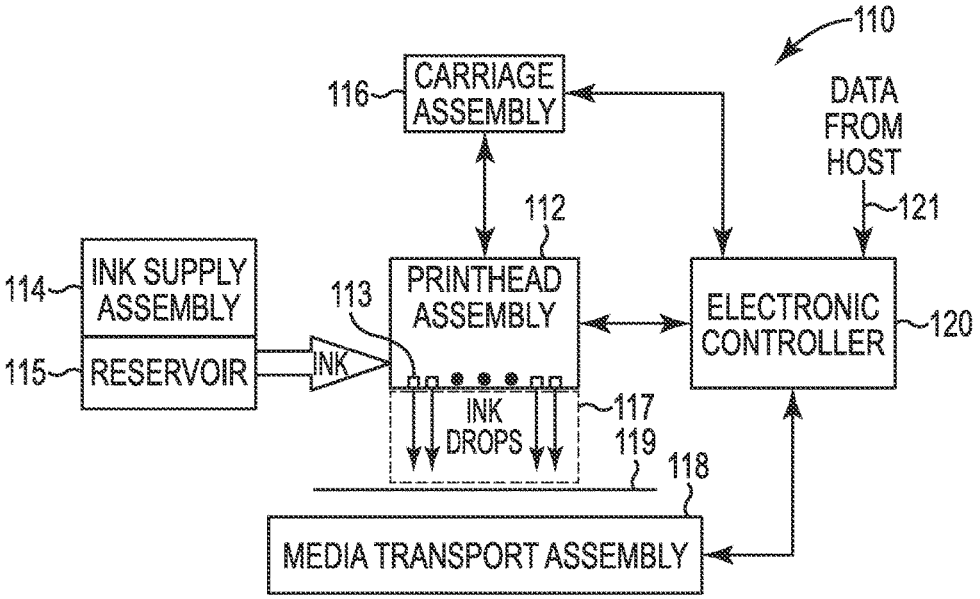
FIG. 3 is a block diagram schematically representing a printer, according to one example of the present disclosure.

FIG. 3 is a block diagram schematically representing an inkjet printing system 110 in accordance with one example of the present disclosure. In some examples, inkjet printing system 100 provides a general environment in which the aspects of printer 22 are incorporated and/or demonstrate at least some general principles by which printer 22 operates.

In some examples, inkjet printing system 100 includes an inkjet printhead assembly 112, an ink supply assembly 114, a carriage assembly 116, a media transport assembly 118, and an electronic controller 120. Inkjet printhead assembly 112 includes a page wide array of printheads (e.g. printhead dies) which eject drops of ink through orifices or nozzles 113 and toward a print medium 119 so as to print onto print medium 119. Print medium 119 may be any type of substrate on which ink can be printed, such as but not limited to a suitable sheet material, such as paper, card stock, envelopes, labels, transparencies, Mylar, and the like. In some examples, medium 119 may be a rigid material or other flexible material, such as but not limited to textiles. In some examples, inkjet printhead assembly 112 prints via nozzles 113 without a receiving medium 119, such as when printing three-dimensional (3D) solid objects.

In some examples, nozzles 113 are arranged in at least one array such that controlled ejection of ink from nozzles 113 causes characters, symbols, and/or other graphics or images to be printed upon print medium 119 as relative movement occurs between inkjet printhead assembly 112 and print medium 119.

Ink supply assembly 114 supplies ink to printhead assembly 112 and includes a reservoir 115 for storing ink. As such, ink flows from reservoir 115 to inkjet printhead assembly 112. In some examples, inkjet printhead assembly 112 and ink supply assembly 114 are housed together in an inkjet cartridge. In some examples, ink supply assembly 114 is separate from inkjet printhead assembly 112 but still directly communicates ink to the printhead assembly 12 via a releasable connection with the ink supply assembly 114 being mounted directly above and at least partially supported by the printhead assembly 112. These examples are sometimes referred to as an on-axis configuration of the ink supply assembly 114.

However, in some examples, the ink supply assembly 114 is positioned remotely from the printhead assembly 112, with the ink supply assembly 114 communicating ink to the printhead assembly 112 via an array of supply tubes. These examples are sometimes referred to as an off-axis configuration of the ink supply assembly 114.

In some examples, carriage assembly 116 positions inkjet printhead assembly 112 relative to media transport assembly 118 and media transport assembly 118 positions print medium 119 relative to inkjet printhead assembly 112. Thus, a print zone 117 is defined adjacent to nozzles 113 in an area between inkjet printhead assembly 112 and print medium 119. In some examples, inkjet printhead assembly 112 is a non-scanning type printhead assembly, such as when the inkjet printhead assembly 112 comprises a page wide array of printhead dies as described within at least some examples of the present disclosure. As such, carriage assembly 116 fixes inkjet printhead assembly 112 at a prescribed position relative to media transport assembly 118. Thus, media transport assembly 118 advances or positions print medium 119 relative to inkjet printhead assembly 112.

Electronic controller 120 communicates with inkjet printhead assembly 112, media transport assembly 118, and, in some examples, carriage assembly 116. Electronic controller 120 receives data 121 from a host system, such as a computer, and includes memory for temporarily storing data 121. Data 121 may be sent to inkjet printing system 110 along an electronic, infrared, optical or other information transfer path. Data 121 represent, for example, an image, a document, and/or file to be printed. As such, data 121 form a print job for inkjet printing system 110 and include print job command(s) and/or command parameter(s).

In some examples, electronic controller 120 provides control of inkjet printhead assembly 112 including timing control for ejection of ink drops from nozzles 113. As such, electronic controller 120 operates on data 121 to define a pattern of ejected ink drops which form characters, symbols, and/or other graphics or images on print medium 119. Timing control and, therefore, the pattern of ejected ink drops, is determined by the print job commands and/or command parameters. In some examples, logic and drive circuitry forming a portion of electronic controller 120 is located on inkjet printhead assembly 112. In some examples, logic and drive circuitry is located remotely from inkjet printhead assembly 112.

Figure 8A:
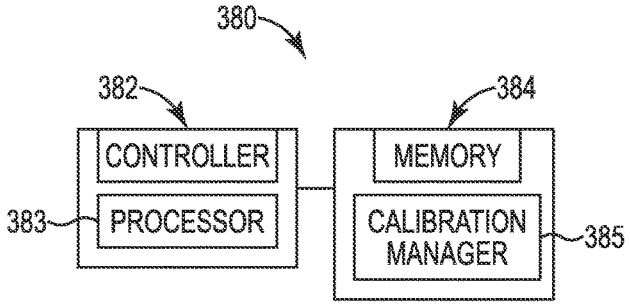
FIG. 8A is a block diagram schematically representing a control portion, according to one example of the present disclosure.

In some examples, electronic controller 120 forms a part of, or operates in complementary association with control portion 80 (FIG. 2) and/or control portion 380 (FIG. 8A).

Figure 4A:
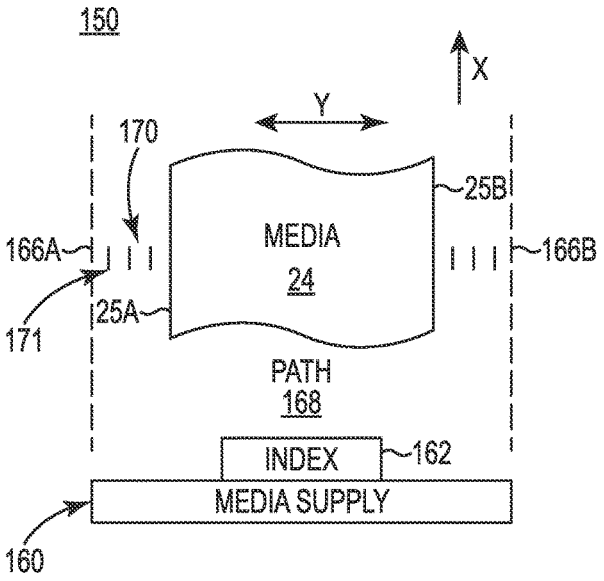
FIG. 4A is a diagram schematically representing a media indexing mechanism, according to one example of the present disclosure.

FIG. 4A is a diagram 150 schematically representing operation of an indexing mechanism 162, according to one example of the present disclosure. In some examples, indexing mechanism 162 forms part of or operates in association with a media supply station 160. As shown in FIG. 4A, medium 24 is aligned for travel along orientation X. Upon installation of a replacement media roll, the indexing mechanism 162 causes an incremental shift (e.g. marked gap 170) in the lateral orientation (Y) of the medium 24 relative to the media path 168, and therefore relative to an array of printing elements (e.g. 32A-32F in FIG. 1). For instance, the indexed lateral shift may occur in increments of 5 mm or another suitable distance. In some examples, each potential lateral shift is represented by one of the marks 171. In some examples, after such a lateral shift by indexing mechanism 162, the edges 25A, 25B of medium 24 become aligned with one of the positioning marks 171. As further shown in FIG. 4A, the 166A, 166B edges of media path 168 define the outer boundaries through which indexed shifting may occur.

In some examples, indexing mechanism 162 intentionally causes the lateral shift of medium 24 to enable utilization of other nozzles on each printhead die, which may prolong the life of the printhead die by avoiding overuse of some nozzles. In some examples, the lateral shift occurs automatically via the indexing mechanism 162 via a trigger event. In some examples, the trigger event corresponds to the installation of a replacement media roll (such as one having the same width). In some examples, the trigger event is each time such replacements are made while in some examples, the trigger event is a certain number of replacements. In some examples, the trigger event is based on a number of printed pages (e.g. 1, multiple, etc.) or based on a volume or rate of ink consumption in printing.

In some examples, a lateral shift in a position of the medium may occur for reasons other than intentional indexing, such as a displacement of medium 24 relative to the core on which it is wound or such as medium skew.

Regardless of the cause of the change in medium position, at least some examples of the present disclosure provide substitute calibration values when appropriate for printing elements not having a current calibration value, as further described herein.

Figure 4B:
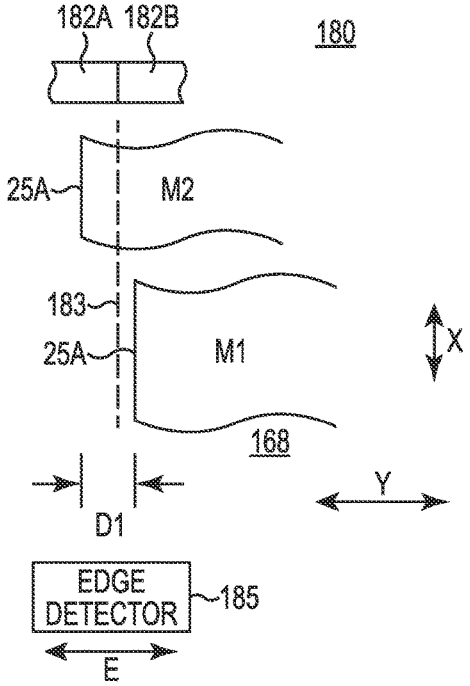
FIG. 4B is a diagram schematically representing aspects of media positioning relative to some printing elements, according to one example of the present disclosure.

FIG. 4B is a diagram 180 including an enlarged top plan view schematically representing the lateral shifting of media upon the replacement of media roll M1 with media roll M2, according to one example of the present disclosure. In some instances, the lateral shifting is intentionally dictated via indexing mechanism of FIG. 4A.

In one example, a magnitude of the lateral shift in the first orientation is represented by D1 in FIG. 4B. Directional arrow Y represents the first orientation in which the lateral shift takes place, which is generally perpendicular to the second orientation in which the media (M1 and M2) are generally aligned for travel along a media path 168 (FIG. 4A). As shown in FIG. 4B, the lateral shift has caused the edge 25A of the second media (M2) to now extend beyond the edge of the printing element 182B, as represented by the dashed line 183 extending from the boundary between printing element 182A and 182B such that edge 25A of media M2 is aligned with a portion of the outer printing element 182A. In the event that outer printing element 182A is a previously non-participating printing element, and therefore does not have a current calibration value, then a calibration value may be substituted for printing element 182A in a manner consistent with the examples of the present disclosure as previously described in association with at least FIG. 1 and/or as will be described in association with at least FIG. 6.

In some examples, the general principles of employing a substitute calibration value for a previously non-participating printing element as demonstrated in FIG. 4B also are applicable to unintentional lateral shifts of the medium attributable to other causes. For instance, the medium may shift laterally relative to an element on which the medium is mounted and from which it is fed into the print zone.

In some examples, as shown in FIG. 4B a printer (e.g. printer 22) includes a media edge detector 185 to detect the position of the edge of medium (M1, M2, etc.). Among other uses, this edge position information may be used by control portion 80 (or 120 in FIG. 3, 380 in FIG. 8B) to determine which printing elements (e.g. 182A, 182B) are participating in calibration and printing. In some examples, the media edge detector 185 is located in proximity to the print zone (e.g. 117 in FIG. 3) and in some examples, the edge detector 185 comprises an optical sensor. In some examples, as represented by arrow E in FIG. 4B, the edge detector 185 is movable in the first orientation (Y) generally perpendicular to the direction of media travel, thereby enabling its media edge measurement duties, among other potential functions. In some examples, the edge detector 185 measures a position of the medium edge upon the loading of medium into the printer, but may also measure the medium edge location at other times.

Figure 5:
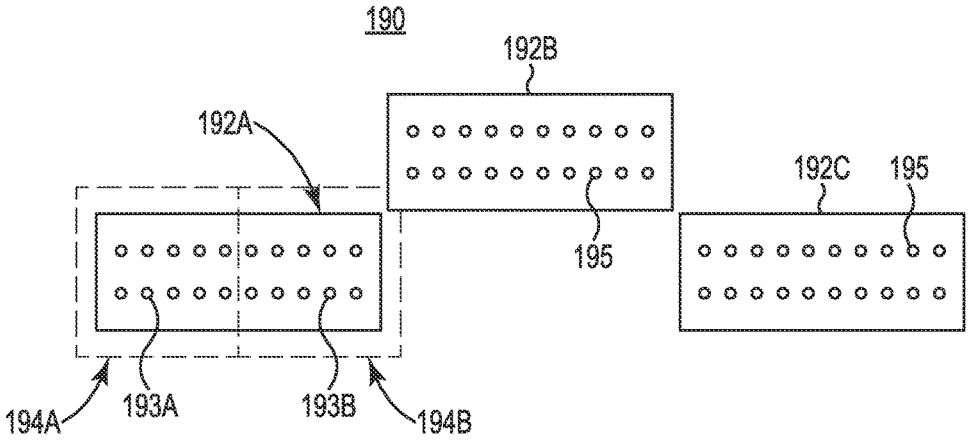
FIG. 5 is a diagram schematically representing some printhead dies, according to one example of the present disclosure.

FIG. 5 is a diagram 190 schematically representing some printing elements 192A-192C, according to one example of the present disclosure. In some examples, at least one of the printing elements 192A-192C may be implemented as one of the printing elements 32A-32F in the printer 22 of FIG. 1. As further shown in FIG. 5, each printing element comprises a printhead die 192A, 192B, 192C, each of which includes an array of nozzles 193A/193B, 195, 195, respectively. Each printhead die 192A, 192B, and 192C corresponds to a whole physical die, including its own plurality of nozzles 193A/193B, 195, and 195, respectively.

However, as further shown in FIG. 5, in some examples, at least one of the respective printing elements (e.g. 192A) may be functionally divided into two logical printhead dies (represented by the dashed line boxes 194A, 194B), with each logical printhead die having its own array of nozzles. In such an example, each logical die can correspond to a separate printing element. Accordingly, in some examples, modification of a calibration value set can be further managed by employing the smaller logical dies 194A, 194B to increase the precision with which calibration values are obtained as compared to processing calibration values according to the relatively larger physical printhead dies. In some examples, the number of logical dies per physical printhead die can be greater than two.

In some examples, all of the physical dies are divided into multiple logical dies, while in some examples, just some of the physical dies are divided into multiple logical dies. In some examples, none of the physical dies is divided into smaller logical dies.

FIG. 6 is a diagram 200 schematically representing at least some printer operations 205, according to one example of the present disclosure. In some examples, the printer operations 205 are implemented via at least some of the features and attributes as previously described in association with FIGS. 1-5 and as will be described in association with FIGS. 7-9. In some examples, as shown in FIG. 6, the printer operations 205 involve an array 210A of printing elements 212A-212F arranged end-to-end to extend transversely across a media path. In some examples, the array 210A represents the entire collection of printing elements for a page wide array of printing elements. In some examples, the array 210A represents a subset of a page wide array of printing elements but having a sufficient number of printing elements to extend fully across a path of at least some media.

In some examples, the printing elements 212A-212F extend along a single print bar.

While the same general array of printing elements 212A-212F are used throughout the printing operations 205 schematically illustrated in FIG. 6, the suffixes A, B, C, D on reference numeral 210 will be used for illustrative purposes to represent different snapshots in time regarding a state of the calibration of the printing elements 212A-212F. Accordingly, it will be understood that the reference numerals 210A, 210B, 210C, 210D all generally refer to the same array of printing elements.

Moreover, while FIG. 6 provides an example of calibration for color uniformity, it will be understood that at least some of the general principles illustrated and described in association with FIG. 6 also are applicable to a calibration for printhead alignment.

When considering calibration for color uniformity, in some examples a printer (e.g. 22 in FIG. 1) stores in memory a calibration value for each printing element 212A-212F. In some examples, the calibration values are expressed as a coefficient, as represented by the indicators Coeff0, Coeff1, etc. and generated as part of a closed loop color calibration process.

As further shown in FIG. 6, the printer operations 205 also involve an array 220A of calibration factors 222A-222E stored in memory. Each calibration factor is represented by the indicator LKGn, LKG1, etc., which stands for Last-Known-Good (LKG) calibration factor. In some examples, the calibration factor 222A is the ratio of the calibration value of one printing element (e.g. 212A) relative to the calibration value of a neighboring printing element (e.g. 212B), and so on, such as the calibration factor 222B involving a ratio of the calibration value for printing element 212B relative to the calibration value for printing element 212C.

In some examples, each calibration factor, such as a LKG ratio, is generated as follows: LKGn=Coeffn+1/Coeffn. If either of the calibration values (Coeffn+1, Coeffn) of two adjacent printing elements is not available, then the calibration factor (e.g. LKGn) is not updated and any existing calibration value is kept.

In one aspect, the relationship expressed in each calibration factor (e.g. 222A) enables storing the relative 'correction factors' between dies. For example, the calibration process may reveal that a printing element 212A (e.g. die 0) needs 7% more ink than its neighboring printing element 212B (e.g. die 1) and enable its correction such that the respective neighboring dies can print with the same general color uniformity. The calibration process can continue with printing element 212B (e.g. die 1) being calibrated against printing element 212C (e.g. die 2), and so on. By storing the relative calibration values between printing elements, if one printing element (e.g. 212B) is recalibrated in the future, the calibration value for its neighboring printing element (e.g. 212A) can still be inferred from the new calibration for printing element 212B in combination with the relative calibration factor, such as the LKG ratio between printing element 212B and 212A. For instance, suppose in some examples that the relative calibration factor (e.g. LKG ratio) between printing element 212B and 212A from a prior calibration event was 1.22, and the re-calibrated value for 212B occurring during a current calibration event was 1.1, then one could infer a substitute calibration value (x) for printing element 212A based on the knowledge that the ratio (1.22) is equal to the value (e.g. 1.1) of printing element 212B divided by the value (x) of the printing element 212A. By solving for "x", one can determine that x is 0.9. Hence, the calibration value of 0.9 was inferred from using the available calibration information regarding printing elements 212A, 212B.

As further shown via array 220B in FIG. 6, upon the installation of the printing elements 212A-212F into the printer, the printer operations 205 involve setting the stored value of the calibration factors 222A-222E to zero, i.e. an unknown state.

As further shown in FIG. 6, via the calibration information stored in memory for array 210B the printer operations 205 may involve calibrating printing elements 212B-212E relative to medium M3 for color uniformity. This calibration operation results in a calibration value of 0.9 for 212B, of 0.8 for 212C, of 1.0 for 212D, and of 1.05 for 212E. In one aspect, medium M3 has a width and position such that its opposite outer edges 225A, 225B are aligned within the outer edges of the printing elements 212B and 212E such that a current calibration value is available for each printing element 212B-212E that is participating in the printing operations 205 on medium M3. Meanwhile, because printing elements 212A and 212F are not participating in the printing operations 205 for medium M3, no calibration value is developed for those printing elements 212A, 212F, which is represented by the indicators N/A (i.e. not available) in array 210B in FIG. 6.

Using these current calibration values, an array 220C of calibration factors 222A-222E is generated and stored in memory. As shown in FIG. 6, the calibration factors 222A, 222B, 222C, 222D, and 222E for array 220C are expressed as ratios (of calibration values between neighboring printing elements) having values of 0.0, 0.088, 1.25, 1.05, and 0.0, respectively. As just one example, the calibration factor 222B of 0.88 is determined by dividing the calibration value (0.8) of printing element 212C by the calibration value (0.9) of printing element 212B.

Meanwhile, in one aspect, the calibration factors 222A and 222E have values of 0.0 because one of the printing elements 212A, 212F involved in those respective calibration factors (e.g. ratios) does not have a value (N/A).

In some examples, a calibration factor may comprise scalar information, while in some examples, a calibration factor may comprise other types of information, such a vector or matrix of values.

As further shown in FIG. 6, at a later time the printer operations 205 may involve medium M4 whose outer edge 225B has a different lateral position (along first orientation X) relative to the array 210C of printing elements 212A-212F.

In one aspect, stored calibration values for array 210B from printing medium M3 are available such that calibration values regarding medium M4 for printing elements 212B, 212C, 212D, and 212E are 0.9, 0.8, 1.0, and 1.05, respectively.

However, prior to commencing printing, the printer operations can recognize that a demand is placed for the participation of printing element 212F to print on medium M4 given the lateral position of outer edge 225B of medium M4. However, the printer operations 205 can further recognize that no current calibration value is available for printing element 212F in array 210B since the last printing operations on medium M3. Accordingly, the printer operations 205 assign a substitute calibration value (1.05) by using the calibration value (1.05) from the nearest neighbor printing element 212E and thereby complete generation and storage of array 210C of calibration values for medium M4.

In some instances, the printer operations 205 can infer a calibration value for printing element 212F from calibration factor 222E in the case where a prior calibration value for printing element 212F had, at one time, previously been available to yield a non-zero value for calibration factor 222E in array 220C. However, in this instance, because of the zero value for calibration factor 222E, the printer operations 205 have employed the calibration value from the nearest neighbor printing element 212E as a substitute for the otherwise null (N/A) calibration value of printing element 212F.

After this substitution, the printer stores a calibration value of 1.05 for printing element 212F regarding medium M4 and printer operations 205 may commence via the stored array of calibration values for array 210 of printing elements.

In some examples, as further shown in FIG. 6, at a later point in time the printer operations 205 may involve another medium M5 having a narrower width and/or different relative lateral position than either prior medium M3 or medium M4. In this instance of printer operations 205, a calibration is performed for medium M5, which produces calibration values 1.0 and 1.1 for printing elements 212C, 212D, respectively. Because the outer edges 225A and 225B of medium M5 are aligned within the outer edges of the printing elements 212C, 212D and all of the participating printing elements having current calibration values, printing operations 205 with media M5 may commence.

However, in some examples, the printer operations 205 also involve using this new calibration information to store in the memory of the printer an updated array 220D of calibration factors for future printer operations with differently positioned media or different width media. Accordingly, for such continued printing operations, the calibration values for printing elements 212C, 212 are used to produce a calibration factor 222C of 1.1 in array 220D. Meanwhile, the calibration factors of 0.88 and 1.05 are carried forward for storage into array 220D (as factors 222B, 222C) from calibration factor 220C as the Last-Known-Good (LKG) factor for the printer operations 205 since no current calibration value is available from printing elements 212B, 212D for array 210D regarding medium M5. Moreover, calibration factors 222A and 222E in array 220D are constructed from the calibration values for printing elements 212A, 212B and for 212D, 212E, each of which has a null value (N/A) because no current calibration is performed for those respective printing elements regarding medium M5. Accordingly, the printer operations 205 assign a value of 1.0 to those factors 222A, 222B to complete the array 220D of calibration factors.

The preceding discussion regarding FIG. 6 schematically represents a calibration for color uniformity, which includes employing an array of calibration factors expressible as a LKG factor. It will be understood that a similar process may be followed to implement a calibration for printhead alignment with its own array of calibration factors, which is separate and independent from the array of calibration factors developed for color uniformity.

In one aspect, this calibration for printhead alignment may compensate for tolerances in the relative positioning of the printing elements. However, in performing calibration regarding printhead alignment, in order to develop the array of calibration factors (e.g. LKG factors), the relationship between neighboring printing elements is treated as a difference (instead of as a ratio) via subtraction of the calibration values. Moreover, the calibration value for each printing element is associated with an absolute value that defines the correction values to be applied to the information it will print. However, in other respects, generating the array of calibration factors generally follows the same principles demonstrated in FIG. 6 in which the calibration factors (for printhead alignment calibration) are generated one at a time by looking at pairs of neighboring printing elements until the whole array of printing elements is considered.

In some examples, the calibration values of at least one of the central printing elements (e.g. 212C) of an array may be invalid while the outer printing elements (e.g. 212A, 212B, 212C, 212E, 212F) may be valid In such cases, a calibration value for the at least one central printing element (e.g. 212C) may inferred from one of the printing elements (e.g. 212A, 212B, 212D, 212E, 212F) having a valid calibration value regardless of the location of the calibration value within the array of calibration values. However, in some examples, the substituted calibration value for the at least one central printing element (e.g. 212C) is inferred from the nearest printing element (e.g. 212B or 212D) having a valid calibration value.

In some instances, inferring the substitute calibration value involves assigning a calibration value to the at least one central printing element that is equal to valid calibration value of one of the printing elements in the array. In some instances, the inferring involves using an available relative calibration factor (such as a ratio from a prior calibration event) and one valid calibration value of a printing element in the array to solve for a substitute calibration value of the at least one central printing element, in a manner consistent with the examples previously described above regarding FIG. 6

Figure 8B:
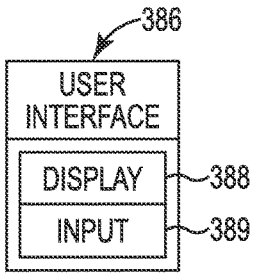
FIG. 8B is a block diagram schematically representing a user interface, according to one example of the present disclosure.

In some examples, a demand may arise in printing operations to print on a medium having a width greater than the medium width used to generate the array of calibration factors, such as for color uniformity. In some examples, if an operator attempts to print on the wider medium, a warning may appear via user interface 386 (FIG. 8B).

Figure 7:
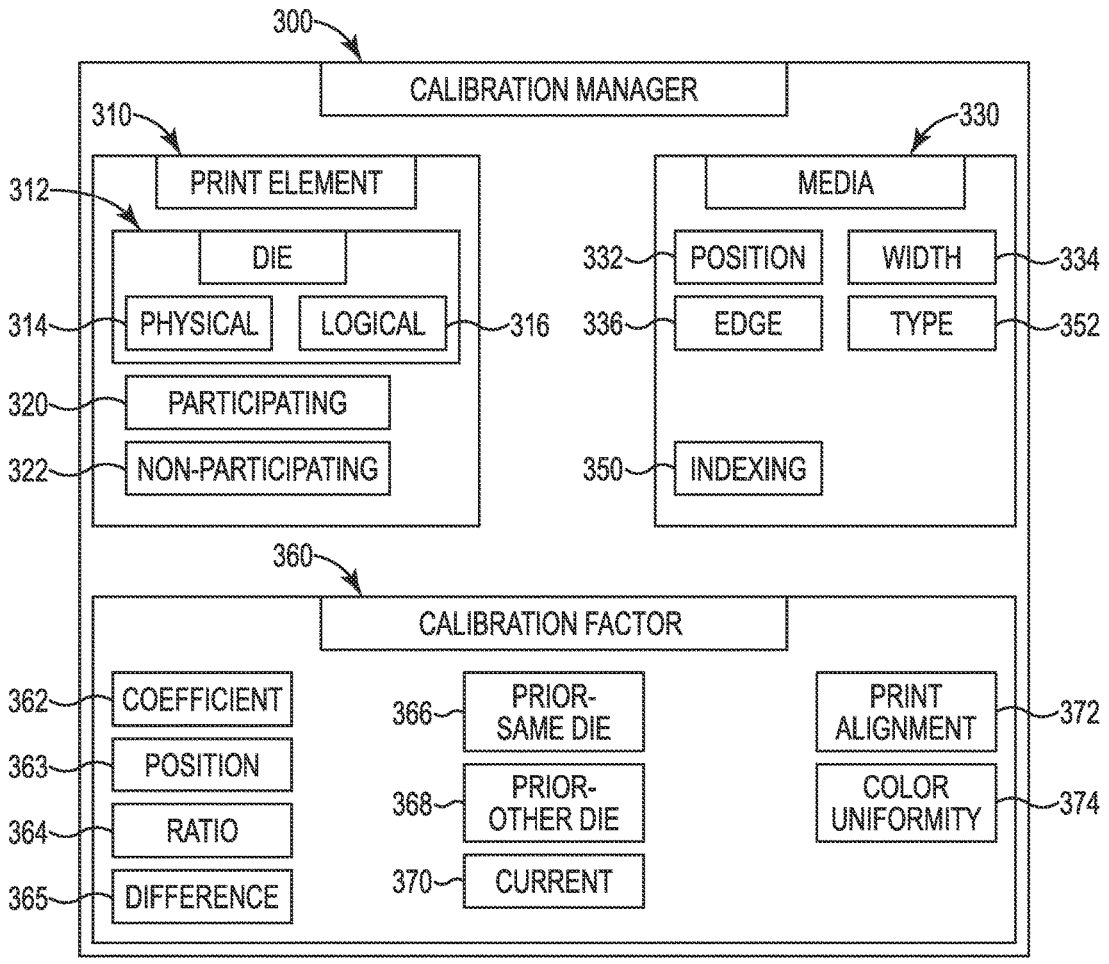
FIG. 7 is a block diagram schematically representing a calibration manager, according to one example of the present disclosure.

FIG. 7 is block diagram schematically representing a calibration manager 300, according to one example of the present disclosure. In some examples, the various parameters, functions, components, and modules of calibration manager 300 may implement the various aspects of printing operations or printers, as previously described in association with at least FIGS. 1-6 and as will be described in association with at least FIGS. 8A-9. Moreover, in some examples, any values determined and/or tracked via the parameters, functions, and/or modules of calibration manager 300 are stored in a memory of printer, such as but not limited to, memory 384 (FIG. 8B).

As shown in FIG. 7, in some examples calibration manager 300 includes a print element module 310, a media module 330, and a calibration factor module 360. In some examples, in general terms the print element module 310 tracks a role played by each printing element of a page wide array of printing elements. In some examples, print element module 310 includes a die function 312 which tracks and/or implements whether a printing element is defined as a whole physical printhead die per physical parameter 314 or is defined as a logical die per parameter 316. In one aspect, the physical die parameter 314 and/or the logical die parameter 316 are further defined by and/or operate consistent with the aspects of the printing elements 192A-192C, as previously described and illustrated in association with at least FIG. 5.

In some examples, print element module 310 includes a participating parameter 320 and a non-participating parameter 322. The participating parameter 320 tracks which printing elements (e.g., printhead dies) are currently participating in a current calibration and/or which printing elements participated in the most recent calibration of the printing elements relative to a medium. The non-participating parameter 322 tracks which printing elements are not participating in a current calibration event and/or which printing elements did not participate in the current calibration event.

In some examples, in general terms media module 330 tracks various positional aspects regarding a medium relative the printing elements. In some examples, media module 330 includes a position parameter 332, a width parameter 334, an edge parameter 336, an indexing function 350, and/or a type parameter 352.

In some examples, the position parameter 332 tracks a lateral position of a medium relative to at least some of the printing elements. In one aspect, the lateral position corresponds to a general position of the medium along a second orientation, which is generally perpendicular to the first orientation, where the first orientation is the orientation that the medium travels relative to printing elements.

In some examples, the width parameter 334 tracks a width of the various media installed within the printer and cooperates with the position parameter 332 because replacing one medium with a different width medium may affect the lateral position of the medium relative to the printing elements. In some examples, the edge parameter 336 tracks a position of at least one or both edges of the medium relative to the printing elements and cooperates with the position parameter 332 and/or the width parameter 334.

In some examples, the indexing function 350 tracks a changing position of the medium via an indexing mechanism, such as indexing mechanism 162, as previously described and illustrated in association with at least FIG. 4A. As previously noted, via the indexing mechanism 162 a lateral position of the media may be intentionally changed. In some examples, such lateral shifts are implemented upon a trigger event, such as but not limited to, the various trigger events previously described in association with at least FIG. 4A. Accordingly, the indexing function 350 may operate to facilitate calibration operations based on a change in the position of a medium. In some examples, the indexing function 350 may operate in cooperation with the position parameter 332 and/or the edge parameter 336. In some examples, the indexing function 350 operates in association with edge detector 185 in FIG. 4B, while in some examples, the indexing function 350 operates independent of edge detector 185.

In some examples, the type parameter 352 tracks which type of medium is available for printing, with at least some of the different types of media having different widths. In one aspect, in the event that two different types of media happen to have the same width, the printer can still use the same calibration value set. In some examples, different types of media are housed in different drawers from which the media may be drawn or fed for printing.

While in some examples a printer generally has at least one array of calibration factors (e.g. LKG factor set), in some examples a printer may store least two separate and independent arrays of calibration factors where the printer supports independent calibration events for at least two different medium types.

In some examples, in general terms the calibration factor module 360 tracks and implements calibration values for each of the respective printing elements. In some examples, calibration factor module 360 includes a coefficient parameter 362 and a ratio parameter 364, which are generally employed in performing a color uniformity calibration. In some examples, the coefficient parameter 362 determines and tracks a unique calibration value associated with a volume of color ink for each printing element. In some examples, the ratio parameter 364 determines and tracks a ratio of the calibration value of one printing element relative to the calibration value of another immediately adjacent (i.e. neighboring) printing element, in a manner previously described in detail in association with at least FIG. 6. As previously noted in relation to at least FIGS. 1 and 6, when a particular printing element is missing current calibration information, a stored calibration factor associated with the ratio parameter 364 may be employed to infer a calibration value for the particular printing element.

In some examples, the calibration factor module 360 includes a position parameter 363 and a difference parameter 365, which can be employed to perform a printhead alignment calibration in a manner previously described in association with at least FIGS. 1 and 6. In some examples, the position parameter 363 determines and tracks a unique calibration value associated with an absolute position of each printing element. In some examples, the difference parameter 365 determines and tracks a difference of the position-related calibration value of one printing element relative to the position-related calibration value of another immediately adjacent (i.e., neighboring) printing element, in a manner previously described in detail in association with at least FIG. 6. As previously noted in relation to at least FIGS. 1 and 6, when a particular printing element is missing current calibration information, a calibration factor associated with the difference parameter 364 may be employed to infer a prior calibration value for the particular printing element.

In some examples, the calibration factor module 360 includes a prior-same die value parameter 366, a prior-other die parameter 368, and/or a current value parameter 370. In some examples, the prior-same die parameter 366 tracks when a substitute calibration value for a printing element is obtained from a prior calibration value set associated with the same printing element (e.g., printhead die). In some examples, the prior-other die parameter 368 tracks when a substitute calibration value for a printing element is obtained from a prior calibration value set associated with a different ("other") printing element. In some examples, the current value parameter 370 tracks when a calibration value for a particular printing element is part of a current calibration value set.

In some examples, the calibration factor module 360 includes a print alignment parameter 372 and a color uniformity parameter 374. In some examples, the print alignment parameter 372 determines and tracks calibrations relating to printhead alignment while the color uniformity parameter 374 determines and tracks calibrations relating to color uniformity. It will be understood that the general scheme of employing substitute calibration values to accommodate a change in which printing elements are participating may be applied to either calibration for printhead alignment and/or calibration for color uniformity. In some examples, the print alignment parameter 372 operates in association with the position and difference parameters 363, 365 while the color uniformity parameter 374 operates in association with the coefficient and ratio parameters 362, 364.

FIG. 8A is a block diagram schematically illustrating a control portion 380, according to one example of the present disclosure. In some examples, control portion 380 includes a controller 382 and a memory 384. In some examples, control portion 380 provides one example implementation of control portion 80 in FIG. 2.

Controller 382 of control portion 380 can comprise at least one processor 383 and associated memories that are in communication with memory 384 to generate control signals, and/or provide storage, to direct operation of at least some components of the systems, components, and modules described throughout the present disclosure. In some examples, these generated control signals include, but are not limited to, employing calibration manager 385 stored in memory 384 to manage calibration for printing elements of a printer in the manner described in at least some examples of the present disclosure. It will be further understood that control portion 380 (or another control portion) may also be employed to operate general functions of a printer 22 (FIG. 1), 110 (FIG. 3), and/or printing operations 205 (FIG. 6). In some examples, calibration manager 385 comprises at least some of the same features as calibration manager 300, as previously described in association with at least FIG. 7.

In response to or based upon commands received via a user interface (e.g. user interface 386 in FIG. 8B) and/or via machine readable instructions, controller 382 generates control signals to implement calibration of printing elements in accordance with at least some of the previously described examples and/or later described examples of the present disclosure. In some examples, controller 382 is embodied in a general purpose computer while in other examples, controller 382 is embodied in the printer (22 in FIG. 1; 110 in FIGS. 3; and 205 in FIG. 6) generally or incorporated into or associated with at least some of the components described throughout the present disclosure, such as control portion 80 (FIG. 2) and/or controller 120 (FIG. 3).

For purposes of this application, in reference to the controller 382, the term "processor" shall mean a presently developed or future developed processor (or processing resources) that executes sequences of machine readable instructions contained in a memory. In some examples, execution of the sequences of machine readable instructions, such as those provided via memory 384 of control portion 380 cause the processor to perform actions, such as operating controller 382 to implement a calibration, as generally described in (or consistent with) at least some examples of the present disclosure. The machine readable instructions may be loaded in a random access memory (RAM) for execution by the processor from their stored location in a read only memory (ROM), a mass storage device, or some other persistent storage, as represented by memory 384. In some examples, memory 384 comprises a volatile memory. In some examples, memory 384 comprises a non-volatile memory. In some examples, memory 384 comprises a computer readable tangible medium providing non-transitory storage of the machine readable instructions executable by a process of controller 382. In other examples, hard wired circuitry may be used in place of or in combination with machine readable instructions to implement the functions described. For example, controller 382 may be embodied as part of at least one application-specific integrated circuit (ASIC). In at least some examples, the controller 382 is not limited to any specific combination of hardware circuitry and machine readable instructions, nor limited to any particular source for the machine readable instructions executed by the controller 382.

In some examples, user interface 386 comprises a user interface or other display that provides for the simultaneous display, activation, and/or operation of at least some of the various components, modules, functions, parameters, features, and attributes of control portion 380 and/or the various aspects of maintaining calibration in printing operations, as described throughout the present disclosure. In some examples, at least some portions or aspects of the user interface 486 are provided via a graphical user interface (GUI). In some examples, as shown in FIG. 8B, user interface 386 includes display 388 and input 389.

Figure 9:
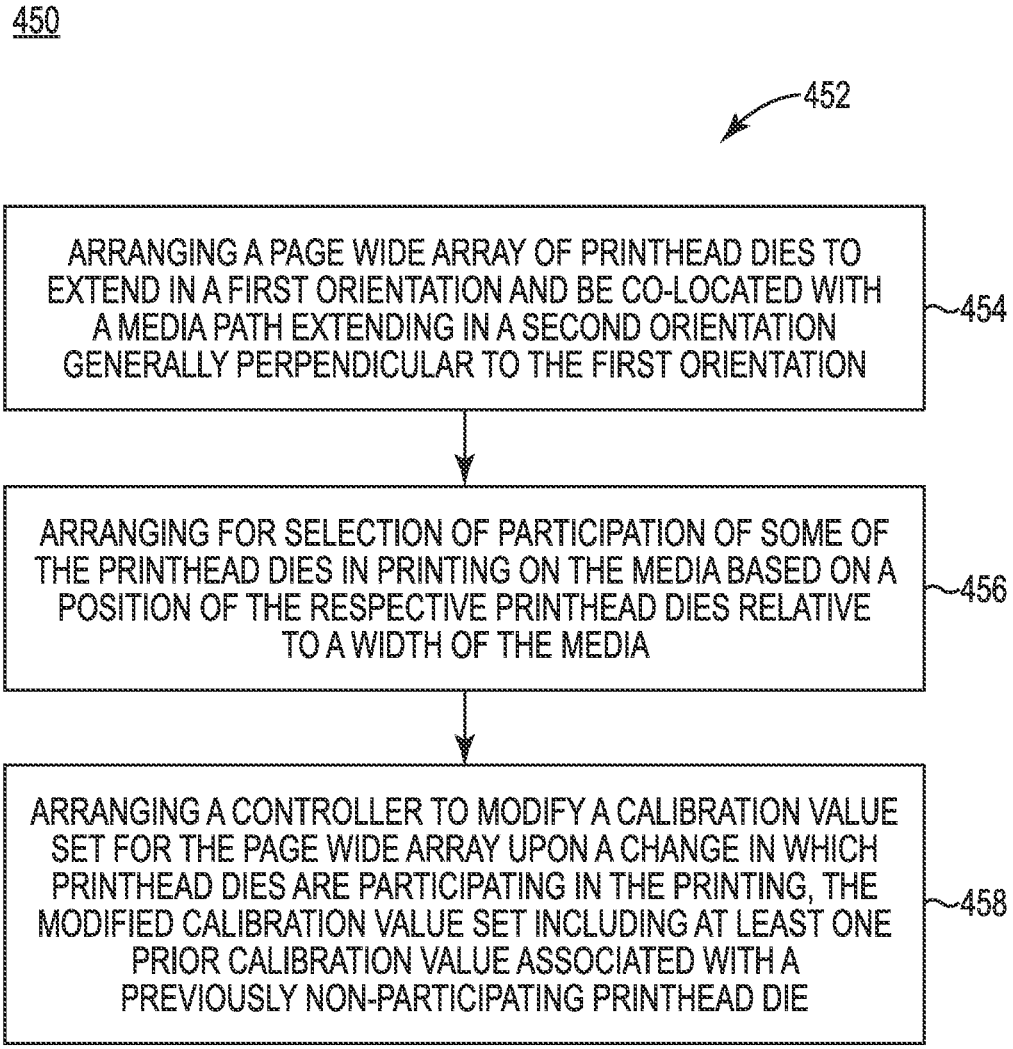
FIG. 9 is a flow diagram schematically representing a method of manufacturing a printer, according to one example of the present disclosure.

FIG. 9 is a flow diagram 450 schematically representing a method 452 of manufacturing a printer, according to one example of the present disclosure. In some examples, method 452 may be performed via at least some of the components, modules, functions, parameters, and systems as previously described in association with at least FIGS. 1-8B. In some examples, method 452 may be performed via at least some components, modules, functions, parameters, and systems other than those previously described in association with at least FIGS. 1-8B.

Accordingly, in some examples, method 452 as shown at 454 in FIG. 9 includes arranging a page wide array of printhead dies of a printer to extend in a first orientation and to be co-located with a media path extending in a second orientation generally perpendicular to the first orientation.

As shown at 456, method 452 includes arranging for selection of participation of some of the printhead dies in printing on the media based on a position of the respective printhead dies relative to a width of the media. Method 452 also includes arranging a controller to modify a calibration value set for the page wide array upon a change in which printhead dies are participating in the printing, the modified calibration value set including at least one prior calibration value associated with a previously non-participating printhead die, as shown at 458 in FIG. 9.

At least some examples of the present disclosure provide for robust calibration for a page wide array of printing elements without involving cumbersome or expensive initial calibration schemes, and while providing for responsive adaptations to changing circumstances regarding a medium relative to the printing elements.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A printer comprising:

a page wide array of printing elements extending in a first orientation and co-located with a media path extending in a second orientation generally perpendicular to the first orientation, wherein the printer is selectively operated according to a calibration involving current calibration values for a first subset of the page wide array of printing elements and a substitute calibration value for at least one non-first subset printing element of the page wide array adjacent to at least one of the first subset printing elements.

2. The printer of claim 1, wherein the selective operation occurs upon identification that one of the current calibration values is not available for the at least one non-first subset printing element to participate in printing on a medium.

3. The printer of claim 2, wherein the identification occurs upon a change in position of the medium relative to the page wide array of printing elements to result in a change in a number of printing elements to participate in printing onto the media.

4. The printer of claim 3, comprising:

an indexing mechanism associated with the media path to cause, upon a trigger event, a lateral shift of the position of the medium along the first orientation.

5. The printer of claim 1, wherein the current calibration values are associated with a first position of the media along the first orientation relative to the page wide array and for which the media was co-located with the first subset of printing elements but not co-located with the at least one non-first subset printing element.

6. The printer of claim 1, wherein the substitute calibration value is at least partially based on the current calibration value of at least one first subset printing element immediately adjacent to the at least one non-first subset printing element.

7. The printer of claim 1, wherein the substitute calibration value is at least partially based on a prior calibration value for the at least one non-first subset printing element, and wherein the prior calibration value is inferred from a calibration factor based on a relationship between the calibration values of an adjacent pair of printing elements.

8. The printer of claim 1, wherein the calibration is at least one of:

a color uniformity calibration; and a printhead alignment calibration.

9. The printer of claim 1, wherein each printing element comprises at least one of:

a whole printhead die including an array of nozzles; and a logical die defined by a portion of the whole printhead die, the logical die corresponding to a portion of the array of nozzles.

10. A printer control portion comprising:

a processor, in association with instructions stored in a memory, to employ a calibration in which a first calibration value set applies to a first subset of printhead dies of a page wide array of printhead dies and at least one second calibration value selectively applies to other printhead dies of the page wide array which are non-available during a determination of the first calibration value set, wherein the at least one second calibration value is at least partially based on at least one of:

at least one the calibration values in the first calibration value set; and at least one prior calibration value associated with the other printing elements and not forming part of the first calibration value set.

11. The printer control portion of claim 10, the processor to execute selective application of the at least one second calibration value upon a change in position of a medium, along an orientation generally perpendicular to a direction of media travel, relative to the first subset printhead dies such that at least some of the other printhead dies become co-located with the medium.

12. The printer control portion of claim 10, wherein the at least one prior calibration value is inferred from a calibration factor based on a relationship between the calibration values of an adjacent pair of printhead dies.

13. The printer control portion of claim 10, which forms part of a system comprising:

the page wide array of printhead dies which extend in the first orientation; and the media supply station to feed a medium for aligned travel along a media path co-located with page wide array and extending in the second orientation generally perpendicular to the first orientation.

14. A method of manufacturing a printer comprising:

arranging a page wide array of printhead dies to extend in a first orientation and be co-located with a media path extending in a second orientation generally perpendicular to the first orientation;

arranging for selection of participation of some of the printhead dies in printing on the media based on a position of the respective printhead dies relative to a width of the media; and arranging a controller to modify a calibration value set for the page wide array upon a change in which printhead dies are participating in the printing, the modified calibration value set including at least one prior calibration value associated with a previously non-participating printhead die.

15. The method of claim 14, wherein the at least one prior calibration value is inferred from a calibration factor based on a relationship between the calibration values of an adjacent pair of printhead dies.

* * * * *